US007559852B2

(12) United States Patent
Werner et al.

(10) Patent No.: US 7,559,852 B2
(45) Date of Patent: Jul. 14, 2009

(54) FACE MARKINGS FOR GOLF CLUBS

(75) Inventors: Frank Werner, Teton Village, WY (US); Richard Greig, Jackson, WY (US)

(73) Assignee: Origin Inc., Jackson, WY (US)

( * ) Notice: Subject to any disclaimer, the term of this patent is extended or adjusted under 35 U.S.C. 154(b) by 0 days.

(21) Appl. No.: 11/712,153

(22) Filed: Feb. 28, 2007

(65) Prior Publication Data

US 2009/0131196 A1 May 21, 2009

Related U.S. Application Data

(60) Provisional application No. 60/840,565, filed on Aug. 28, 2006.

(51) Int. Cl.
*A63B 53/04* (2006.01)

(52) U.S. Cl. ..... 473/314; 473/409

(58) Field of Classification Search ..... 473/314, 473/409

See application file for complete search history.

(56) References Cited

U.S. PATENT DOCUMENTS

| | | | | | |
|---|---|---|---|---|---|
| 723,534 | A * | 3/1903 | Knight | 473/313 |
| 3,595,577 | A * | 7/1971 | Hodge | 473/314 |
| 3,625,517 | A * | 12/1971 | Durnack | 473/313 |
| 4,222,567 | A * | 9/1980 | Shabala | 473/242 |
| 4,725,062 | A * | 2/1988 | Kinney, III | 473/330 |
| 5,199,707 | A * | 4/1993 | Knox | 473/314 |
| 5,228,332 | A * | 7/1993 | Bernhardt | 73/65.03 |
| 5,413,345 | A | 5/1995 | Nauck | 473/156 |
| 5,703,294 | A | 12/1997 | McConnell et al. | 73/579 |
| 5,763,770 | A | 6/1998 | McConnell et al. | 73/65.03 |
| 6,024,653 | A * | 2/2000 | Goodrich | 473/314 |
| 6,190,267 | B1 * | 2/2001 | Marlowe et al. | 473/314 |
| 6,224,494 | B1 | 5/2001 | Patsky | 473/253 |
| 6,431,990 | B1 | 8/2002 | Manwaring | 473/199 |
| 6,506,124 | B1 | 1/2003 | Manwaring et al. | 473/198 |
| 6,561,917 | B2 | 5/2003 | Manwaring | 473/151 |
| 6,602,144 | B2 | 8/2003 | Manwaring et al. | 473/198 |
| 6,659,882 | B2 * | 12/2003 | Patsky | 473/292 |
| 6,716,114 | B2 * | 4/2004 | Nishio | 473/314 |
| 6,821,209 | B2 | 11/2004 | Manwaring et al. | 473/198 |
| 6,929,558 | B2 | 8/2005 | Manwaring et al. | 473/198 |
| 7,331,877 | B2 * | 2/2008 | Yamaguchi et al. | 473/329 |
| 2007/0066419 | A1 * | 3/2007 | Matthew | 473/314 |
| 2007/0238545 | A1 * | 10/2007 | Fountaine | 473/314 |

* cited by examiner

*Primary Examiner*—Stephen L. Blau
(74) *Attorney, Agent, or Firm*—Westman, Champlin & Kelly, P.A.

(57) ABSTRACT

Improved golf club heads indicating the location of an optimum hit point on the striking face for maximum shot distance of any hit location on the face ("maximum distance spot", called MD) and an indication of a second optimum hit point giving best distance, with the condition of minimum or no change of torque caused feel as perceived by the golfer at impact ("best feel spot," called BF) are disclosed. Methods to locate these optimum locations are described. It has been widely assumed and believed that these two points have the same location. The present inventors have found that this is not true. The principal application is to "wood" type golf clubs designed to hit golf balls from a tee, but can provide useful information for clubs hitting balls from the ground. The indication of MD and BF locations on the club face may take any of various forms.

9 Claims, 3 Drawing Sheets

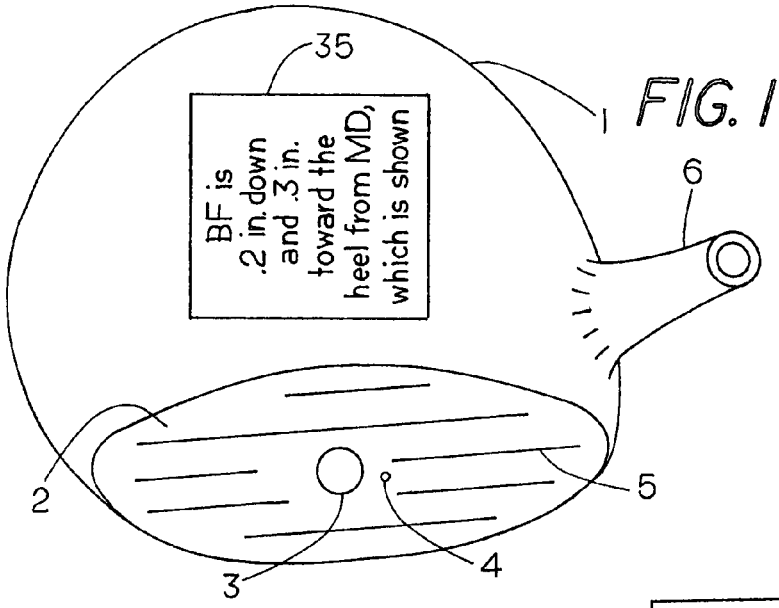
FIG. 1
FIG. 2
FIG. 3
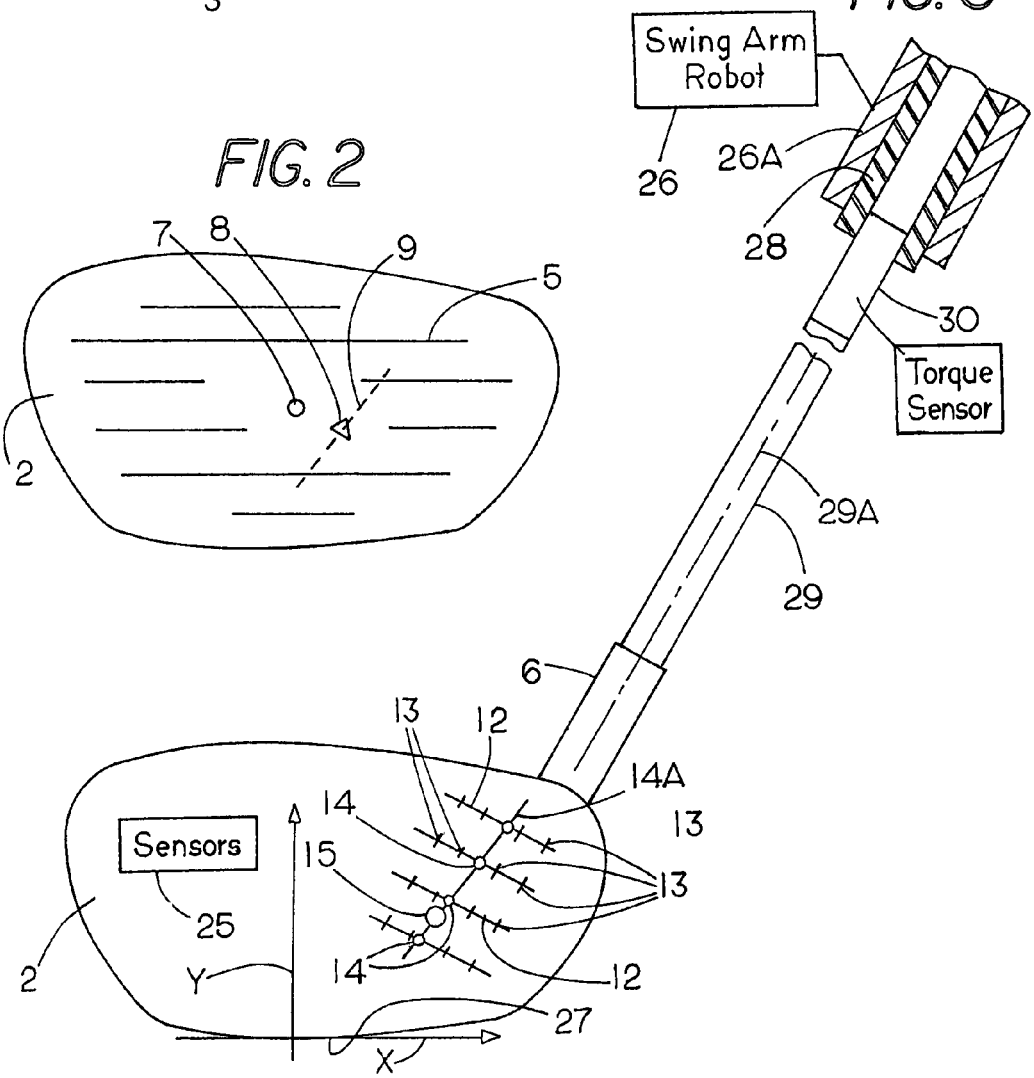

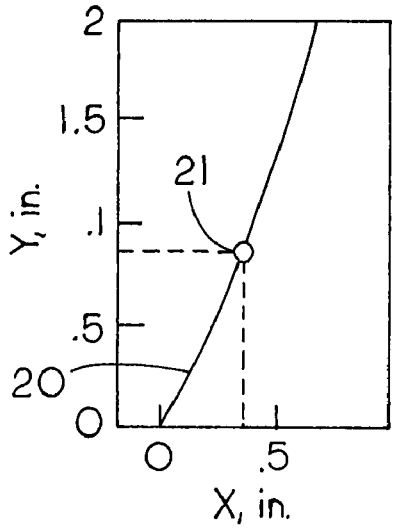
FIG. 4
FIG. 5
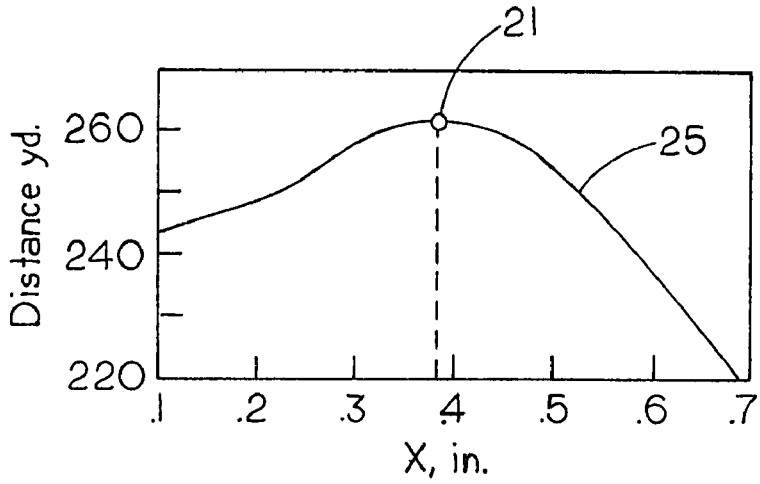
FIG. 6
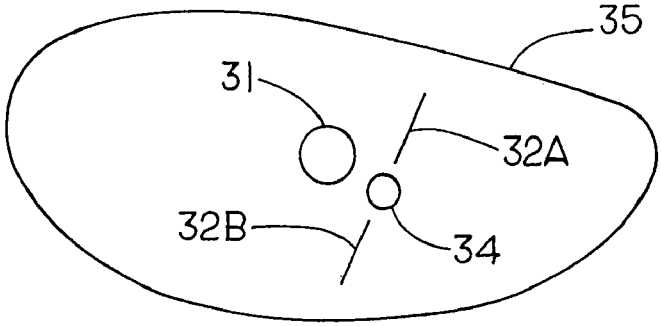

FACE MARKINGS FOR GOLF CLUBS

This application refers to and claims priority on U.S. Provisional Patent Application Ser. No. 60/840,565, filed Aug. 28, 2006, which application is incorporated by reference.

BACKGROUND OF THE INVENTION

The "sweet spot" concept has long been recognized by club designers and by golfers. It is commonly marked as a circle near the center of the face. Squares or other marks are also common. This is generally considered as the spot to hit for maximum distance. A common observation in golf has been "the best feel is no feel" meaning that if there is little or no perceptible feeling of the grip twisting at the time of impact, one has hit on the sweet spot, resulting in maximum distance of the shot.

In a more detailed study, our research has shown that there is one location for a hit for maximum distance ("maximum distance spot" or MD) and another ("best-feel spot" or BF) that is generally a fraction of an inch away. BF is the location of impact for no momentary change of rotation speed of the grip nominally around the long axis of the shaft together with best distance for that condition of no change of rotational feel at the grip. The difference of distance of a shot from each of these locations is approximately 1 to 3 yards, depending on club head design, head speed at impact, and other factors. It is believed that golfers would like to know where they should try to center the impact for each case, and an indication of each of these two points is desirable. It was found that the distance of a golf shot is always less when hit at BF as compared with a hit at MD.

PRIOR ART

No prior art has been found for recognizing or indicating MD and BF. The present inventors and other club designers use modern computer programs to assist in designing golf club heads. Examples for other inventors using design programs are U.S. Patents by inventor(s) Manwaring et al: U.S. Pat. Nos. 6,431,990, 6,506,124, 6,561,917, 6,602,144, 6,821,209, and 6,929,558. Such computer code can be used or could be modified to perform the calculations required for the novel method for defining these two optimum spots. It is probable that there are various other cases of club designers using suitable computer programs. So far as is known, such methods have never been used to define these two points. When the existence of such two, unique, and optimum spots has been calculated, no known prior art shows the use of two marks on a clubface or one mark with an accompanying description of the relative location for the other location.

U.S. Pat. Nos. 6,224,494 and 6,659,882, both by Patsky, discuss methods of locating "ideal points of contact with a golf ball" also called "sweet spot" and apparently other descriptions. In '494, two references to FIG. 11 (col. 11, lines 35-37 and col. 15, line 65 to col. 16 line 9) indicate use of a "Club Torque Responder" located at the butt end of the grip. This instrument is used during dynamic clubhead impacting "to measure Sweet Line off or on hits with related derivatives and . . . ". It further states in the paragraph starting at col. 4, line 38: "This patent encompasses new engineering design principles in golf clubs, their manufacture and fitting, applicable to alignment markings and identification at any clubhead location, on or within the clubhead, adjustable or fixed, within or external to the impact area as defined by the USGA or other entities, visual or nonvisual, color coded, blended or otherwise, singular or plurality, and in any mannerism, allowing the golfer to automatically and exactly align the clubhead to a ball at any height (emphasis added), but basically at two heights, from the Ground or perched on a Tee, whereupon at ball impact results in the transferal of optimum power, control and direction of intent." The hit point locations on the Sweet Line at these two heights define the Ground Sweet Spot and the Tee Sweet Spot, two of five subdivides of the Infinite Sweet Spots on the Sweet Line, see Col. 5, lines 6-11. The other three subdivides on the Sweet Line are defined as:

- Maximum Sweet Spot—"The Maximum Sweet Spot 16, is a point on the end of the bat offering maximum power and control for the direction of intent, that may never be facilitated because of the ball diameter." (col. 12, lines 28-31) In reference to golf clubs, the Maximum Sweet Spot 16 is at the intersection of the Sweet Line and the sole portion of the face perimeter".
- Optimum Sweet Spot—"The Optimum Sweet Spot 17, is a point on the bat that takes into regards many parameters including Swing Plane 1, Swing Plane Arc 27, and Swing Plane Radius 36, that is dependant upon the object or ball diameter, compression, etc., wherein hitting the ball square, results in optimum power and control for the direction of intent." (col. 12, lines 32-37) It is also described as "the varying Optimum Sweet Spot 17" (col. 13, lines 14-15) as compared to a unique point on the Sweet Line.
- True Sweet Spot—"The True Sweet Spot is associated with clubheads designed to hit a Ball Impact Point, primarily from one reference point, such as the ground, that can be any combination of the Six Sweet Spots, or of a general independent or reference nature. The True Sweet Spot can be used to strike a ball at another height if the club lie angle is altered." (col. 5, lines 12-17) There is no teaching in '494 or '882 that the True Sweet Spot is that spot on the Sweet Line with no feel and best distance.

There is no teaching in '494 or '882 instructing the golfer to tee the ball at an optimum or preferred height and make lateral adjustments to hit on the Sweet Line to result in a shot with best feel and maximum distance, which is here defined as the BF sweet spot or location.

U.S. Pat. No. 5,763,770 (McConnell et al.) describes a method of studying continuous vibrations that supposedly provides means to locate what is therein called the "sweet spot". Their definition of "sweet spot" is not defined as the spot for maximum distance of a hit. More importantly, vibration frequency for an impact is not a single, continuing frequency of vibrations as stated in '770 but rather, is made up of a summation of many frequencies as can be defined by a Fourier analysis of impact forces that shows frequency vs. amplitude to precisely represent the impact. Also, this method does not consider the angular velocity of the head at impact resulting from golfer wrist rotation. Therefore, the sweet spot it defines is of little meaning to the golfer. The methods of the present invention use methods that are appropriately related to actual ball-club impacts and clearly relate to a "sweet spot" resulting with maximum distance (MD sweet spot) and/or a "sweet spot" resulting with best distance under the condition of minimum torsional feel (BF sweet spot), both having clear meanings as discussed herein.

U.S. Pat. No. 5,703,294 (McConnell et al.) is related to '770 in that it is based on continuous vibrations and does not define locations for MD and/or BF as defined and discussed in the present application. The '294 patent has similar shortcomings as '770 regarding club head rotation at impact resulting from golfer wrist angle rotation at impact, included in all the claimed methods here.

None of this prior art shows the novel methods claimed herein for locating BF.

SUMMARY OF THE INVENTION

A golf club head is disclosed which has a ball striking face that includes a mark at the point for which a golfer should try to center hits when seeking to maximize ball travel distance (MD) regardless of a change of twist of the club and an indication or mark at a second location when seeking best ball travel distance with "no feel" of change of twist of the club (BF).

Several suitable alternate methods for identifying these two locations are described, including using a robot golf ball striker and a computer analysis method. The first mark is for maximum distance of ball travel for any hit location on the club face as established by these methods. The second mark on the club face is a point where there is maximum ball travel and no change of twist or torque on the club shaft caused by impact, called the Best Feel or BF. The BF point can be established by computer analysis directly.

Also, using a robot golf ball striker or a live golfer, a locus of ball strike points can be established where there is no change of twist or feel of rotation of the golf club shaft and grip, which locus of points form a line on the clubface. For ball strike or hit points along this line, ball travel distance varies, but feel does not, in that the golfers perception of a momentary change of twist at the grip is at or near zero. The method then includes determining the point along the "no feel" line where ball travel distance is the maximum. BF is a unique point on this "no feel" line, where the distance of the shot is greatest, and there is no change of torque on the golf club shaft from the hit.

BRIEF DESCRIPTION OF THE DRAWINGS

FIG. 1 shows a view downward and toward the face of a club head and a basic form of the club face markings disclosed is indicated.

FIG. 2 is a view toward the face of a club head, showing one option of the club face novel markings in the case of a modern, spring-effect, large-face driver design with the club face markings located approximately to scale.

FIG. 3 is a view of a driver clubface illustrating one procedure of the measurement steps that determine the location of the point BF by means of a golf robot.

FIG. 4 is a graph of hit locations on the clubface resulting with zero change of torque or twist about the club shaft or grip axis (and thus no change of torque or torsional feel by the golfer) where X is the distance from face center toward the heel end of the face and Y is the distance upward from the sole line.

FIG. 5 is a graph of hit distance for hit locations on the line of no change of torque or torsional feel of FIG. 4 versus X, where X is the distance of the hit location from the face center toward the heel end of the face.

FIG. 6 shows one of several versions of the marking of MD and BF, illustrating that a straight line may be used to approximate the zero change of torque feel line that may be slightly curved as shown in FIG. 4.

DESCRIPTION OF THE EXEMPLARY EMBODIMENT

Figure 7:
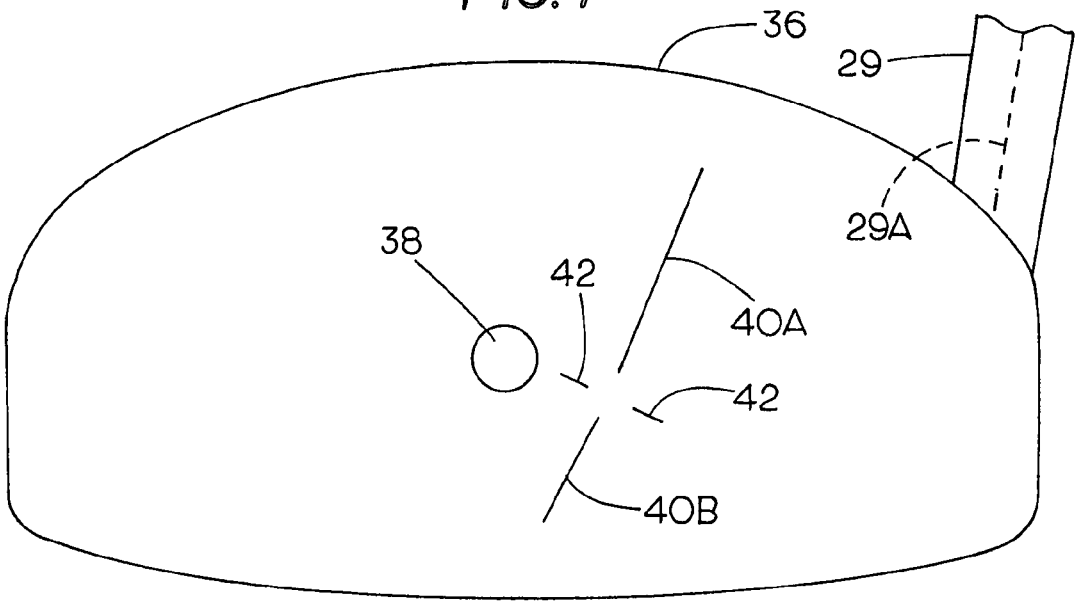
FIG. 7 illustrates a different club head design from that of FIG. 6 and straight line segments that approximate the ideal slightly curved line for zero change of torque, and with other straight line segments all intersecting at BF.

The abbreviations MD and BF or their names, as defined above, are used in this invention and in its claims. Unless specifically stated otherwise, the axis for terms such as torque, rotation, or twist refer to the long axis of the shaft and grip.

Humans feel quick movements such as riding in a car on a bumpy road. It is well established that the feeling is mainly a human response to changes of acceleration. (Steady acceleration does not cause the feeling, for example, the acceleration due to gravity.) This also applies to rotary motion, for example, during a golf swing, if the grip of a club is a feeling of steady angular acceleration with this acceleration suddenly altered by impact of clubface and ball, the golfer perceives this as a twisting disturbance or a change of twist, usually referred to in the following as a "change of twist" or "change of torque", or simply "twist" or "torque".

The present inventors determined that there exists a line on a club face that is roughly in a direction indicated by the dashed line at 9 in FIG. 2, for which a hit anywhere along this line causes no change in acceleration of the shaft rotation and thus zero change of torque and no sudden change of twisting feel by the golfer. The line is referred to at times in this specification simply as the "no feel" line. Importantly, the present inventors discovered that for hit points along this no feel line 9, there is a unique point that results in greatest distance. This is the best-feel spot or BF, as defined above. Hits elsewhere along line 9 give less ball travel distance and also alter the direction at which the ball is launched. There is no change of rotation or torque at impact for hits along the "no feel" line.

At club-ball impact, there is also a small vibration that is perpendicular to the long axis of the club shaft (it would cause a tendency for the shaft to bend). This has relatively small changes in lateral acceleration of the grip and its feel is usually overshadowed by any rapid change of rotation. As a result, with respect to the feel at impact, change of rotation at impact is the important factor to be considered.

The inventors have done substantial research on the problem of where a golfer should try to center hits on the clubface. Most of this work was studied by a computer simulation program that has extensive ability to show important details of the shots resulting from any combination of a large group of design and usage variables. A further explanation of the inventors' computer program is in Chapter 2 the book *How Golf Clubs Really Work and How to Optimize Their Designs,* ©2000, published by Origin Inc. Also as noted in the above section on prior art, other computer programs exist, or could be modified, to have this capability.

A basic alternate to computer study to find the BF and MD points is to use a golfing robot 26 whose clamp for gripping the club is shown as 26A (FIG. 3). Such devices are now well known and widely used by golf club designers. Briefly, the golfing robot consists of a machine with a clamp to serve as a real golfer's hands. The mechanism holds a golf club in the same way as a real golfer. It has a mechanical drive to swing the club almost exactly as a real golfer would swing. The club head path, speed of swing, wrist angle rotation rate, and other important variables modeling a golfer swing can be set to be repeatable.

In principal, an alternate would be to use a real golfer for testing, but accuracy of that procedure would be greatly complicated by variations of the golfer's swing, measuring the torque on each hit, and other experimental factors that are not subject to control. This would require measuring of locations of hits on the face for each trial, and a more complicated process of reducing the data by statistical processes applied to a relatively large number of trials.

For the golfing robot 26, hits could be studied on a fairway, but more precise results are realized by measuring the direction, speed, and spin of the ball by electronics means using known sensors represented schematically at 25, on the club head and/or on associated equipment, after an impact by the robot golfer. Means for such measurements and for calculating distance of each hit are well known and widely used in the industry, for example as described in U.S. Pat. Nos. 5,413,345 (Nauck); 6,929,558; 6,821,209; 6,602,144, 6,561,917 and 6,431,990, (all 5 by Manwaring et al.). The teachings of these prior art patents are incorporated by reference.

For this method of finding BF, the essential addition to the robot golfer 26 and the known processes of measuring direction, speed, and spin of the ball, is to add a sensor 30 to measure torque or torsion variations at the grip that are caused by impact. A way to do this is to mount strain gages on the club shaft, preferably near the grip, that can measure torsion around the long axis of the club shaft and do so regardless of any bending of the shaft that may be present. This arrangement forms the torque sensor 30. Various known strain gage arrangements or related devices can provide this measurement of torsion. These strain gage methods and other torsion measuring devices are well known to those skilled in measuring stress and strain.

FIG. 3 is a view toward a clubface. It illustrates a suitable sequence of hit point locations that may be made with the robot golfer indicated schematically at 26. The procedure to find the point BF is to use the robot 26 to swing the club and strike a ball at a predetermined location and club head speed. The location of each impact point is defined by an X coordinate being the horizontal distance from the face center toward the heel of the club and a Y coordinate being the vertical distance above the sole of the club. The X and Y axes are shown in FIG. 3. At each hit location 13 shown in FIG. 3, the measurement of the positive or negative values of angular torque on the grip 28 or shaft 29 and the hit distance or ball travel from impact are recorded. As shown in FIG. 3, the impact locations are on several spaced apart, generally parallel lines 12. The angular torque serves to indicate angular acceleration about the long axis 29A of the club shaft. Lines 12 are nominally perpendicular to the long axis of the club shaft, but can be at a somewhat different angular position without affecting results. The lines 12 should be angled upwardly in direction from the heel to the toe of the club head relative to the sole 27. When these measurements are made for at least 3 and preferably 4 or more different lines 12 with at least 3 and preferably 4 or more different hit points 13 on each line, the robot golfer test for determining BF is complete.

A graphical process is described below to illustrate the process of determining BF. Those skilled in data treatment will realize that this method for finding BF can be done more precisely by computer processes in place of the graphical process described. In other words, computer analysis using the recorded measurements of hit location, torque, and hit distance described above can establish the locus of points of no torque on the club shaft during a ball strike and then also determine BF along the "no feel" or no change of torque line or directly determine BF without establishing the no feel line.

Step 1 is to create a graph for each line 12, plotting the values of shaft torque versus the X coordinate of the hit location for each point 13. Next, connect the points with a best fit line and determine the X and Y (through the equation for the line 12) coordinates of the point such as 14 where the torque or twist on the shaft 29 and grip 28 is zero.

Step 2 is to create similar graph for each line 12 plotting instead the values of hit distance versus the X coordinate of the hit location at each point 13. Next, connect the points with a best fit line and determine the hit or ball travel distance at the hit location determined by the X coordinate of point 14, the zero torque hit location found in Step 1.

Step 3 is shown in FIG. 4, where the location of the zero-torque points 14 of Step 1 are graphed, Y coordinate versus X coordinate. Connecting these points determine a best fit line 20 in FIG. 4 representing the no torque line.

Step 4 is shown in FIG. 5, where the hit distance determined in Step 2 is plotted against the X coordinate of point 14 for each line 12. A best fit curve 25 in FIG. 5 drawn through these points shows the center point for obtaining best hit (ball travel) distance, which is indicated at 21 in FIG. 5.

For illustration, point 21 determined in FIG. 5 at a point along line 25 has been marked on FIG. 4 on line 20 (both points have the same X coordinate value), to display the X and Y coordinates of the location of BF on the face.

BF can be determined directly by a computer analysis that models club ball impact and subsequent flight and bounce and roll of the ball combined with a numerical procedure to iterate on X and Y coordinates of hit locations on the club face. For each hit location, a linear function, which is a linear combination of shaft torque and the inverse of ball travel distance is calculated. The iteration procedure chooses the next hit location based on its criteria to minimize the linear function. The hit location minimizing this function provides the location of BF. The path of hit points tried during this process depends on the initial or starting hit point(s) specified and the details of the iteration process used.

In summary, if a hit is well toward the toe or heel, the off-center impact causes a change in rate of rotation of the head about the shaft axis 29A, loss of distance, and a direction change of the ball flight. This change of rotation rate is quickly propagated up the shaft and is readily perceived by the golfer as a twisting sensation of the grip caused by torque. This torque is measured in the present method and the series of zero torque points determined.

It is interesting to consider a strong hit that is far off the face center. If the golfer did not resist, the rotation rate would change in less than about one half millisecond by 2500 revolutions per minute or more. The golfer's grip strongly reduces this, and therefore the golfer feels a strong twisting sensation at the grip. The change of 2500 rpm rate compares to change of zero or a few revolutions per minute for hits at or very near BF or at any other point along the no feel line.

Thus, this twisting is the main factor in a golfer's feel at impact. It is an important factor that was studied in the research on where a golfer should try to center hits on a clubface.

Locating MD is simpler, well known, and widely practiced. Using robot golfer tests, it requires recording locations of a number of hits on the face and the ball travel distance for each. Either graphical or computer means can then fit the data with a 3-dimensional surface to identify the point on the face that gives maximum distance, regardless of whether there is torque on the shaft or not, which is MD. Such graphical methods are similar to the above but simpler. Another approach is using the computer analysis described in the previous paragraph using a minimizing function of the inverse ball travel distance.

In general, the research showed that hits for the BF condition should be centered a fraction of an inch toward the heel and slightly lower on the face relative to the MD position.

FIG. 1 illustrates a modern, large sized, typical golf club head, numeral 1. The face is indicated at 2. The location of these two optimum points to center hits on the face is generally indicated by the two points 3 and 4, where 3 (MD) gives maximum distance and 4 (BF) gives maximum distance for the condition of no or minimum torque or twisting feel as defined above. Commonly used, but sometimes omitted are score lines 5. The hosel is shown at 6.

FIG. 2 is a view toward the face. It displays other markings where 7 represents the MD location. The locus of points where there is no twisting feel (zero torque) at the golfer's grip is shown as the dashed line 9, and 8 indicates the location along this line of no-feel that gives best distance (BF). The marks or indicia are different from each other for identification.

Most golfers may prefer to hit at location 3 in FIG. 1 or 7 in FIG. 2 for maximum distance. Others would prefer best feel at location 4 or 8. One reason is that, as indicated below, location 4 or 8 sacrifices only a small distance of the shot and tends to indicate to the golfer, the toe-heel location on the face where he hit.

The location of each of these two points depends on the design of the club head, such as the loft and lie angles, the location of the center of gravity and the inertia matrix terms. The locations also vary somewhat with the head speed generated by the golfer and other golfer variables. Results caused by such design and golfer variables are illustrated by differences shown when all of the figures are compared with one another and with Table 1 (discussed below).

Examples of these locations are shown in Table 1. These examples are based on having optimized (ideal) loft angle and consistent swings with the same head velocity or speed for each case. Table 1 shows that shot distance, "dist", is slightly reduced in every case if BF is the chosen hit location over the MD location.

A third option is to mark on the face, one of the locations such as the MD. In this case, a second mark for BF is not made on the face. Instead, it is defined by printing instructions for locating BF such as on the top of the club head shown at 35 in FIG. 1 to state that BF is certain distances toward the heel and downward, both relative to the maximum distance (MD) mark. Optionally, this may be done with a BF mark on the face and MD location indicated by similarly printing the distance toward the toe and upward from the BF mark. If desired the dotted line 9 of FIG. 2 may be marked on the clubface. FIGS. 6 and 7 show other alternates for markings showing MD, BF, and representations for the line of no feel. Many other marks could be used for these indications.

FIG. 6, shows a first modified face shape of a club head 35. Point MD for this club head is illustrated as a circle or dot 31. The segmented line of no feel indicated as 32A and 32B is straight and collinear as shown and approximates the slightly curved line 20 of FIG. 4. BF is indicated at 34. The USGA treats face marks defining the no feel line as grooves and requires them to be straight lines.

FIG. 7 shows a further modified face shape of a club head 36. MD is indicated at 38. The line segments 40A and 40B form a line that is a closer approximation of the ideal, slightly curved line 20 shown in FIG. 4. As shown, these segments are not collinear but extensions of these line segments intersect at BF. BF is also indicated by line segments 42 and line segments 40A and 40B, which, if continuous, cross at BF.

It is preferred and required by the USGA to conform to the Rules of Golf that the line segments 40A, 40B, and 42 as marked on the club face terminate short of the point BF and be straight, as shown in FIG. 7. Imaginary or real extensions of the marked line segments cross at BF.

TABLE 1

Results of MD and BF calculations. B3 is a large, modern club and WA is an old style, wooden head. HS is head speed, mph. MD and BF are as defined above. Distance from face center toward heel is X and distance above the sole is Y, both in inches. Hit distance is dist, yards. Change in angular velocity of the shaft, if it were free to turn, is dAV in revolutions per minute. The distance (inches) between MD and BF is shown at L.

| | HS | MD | | | | BF | | | | L |
|---|---|---|---|---|---|---|---|---|---|---|
| Club | [mph] | X | Y | dist | dAV | X | Y | dist | dAV | [in.] |
| B3 | 100 | −0.36 | 1.54 | 257.49 | 75.6 | −0.07 | 1.36 | 254.36 | 0 | 0.34 |
| B3 | 80 | −0.36 | 1.57 | 203.35 | 56 | −0.09 | 1.39 | 201.1 | 0 | 0.32 |
| WA | 100 | 0.04 | 1.08 | 245.72 | 77.5 | 0.19 | 1.15 | 244.65 | 0 | 0.17 |

A preferred option is to mark each of these two positions (MD and BF) as shown in FIG. 1, where one mark may be a circle, square, diamond shape or other suited mark, and the other has similarly chosen but preferably visually distinct marking such as the punch mark shown in FIG. 1. Both may be punch marks A second option is to mark a line, one end of which defines hit location for MD and the other end locates BF as shown in FIG. 8.

An industry standard is for the face mark to be within a 0.375 inch square. This limits some of these options. For example if the separation, L, is 0.32 or 0.34 inches for Table 1, small marks would fit within the 0.375 inch square. However if the marks for MD and/or BF are large, parts of the marks would not fit within the square. Other head designs may have larger values of the separation between MD and BF (L, see table above).

Figure 8:
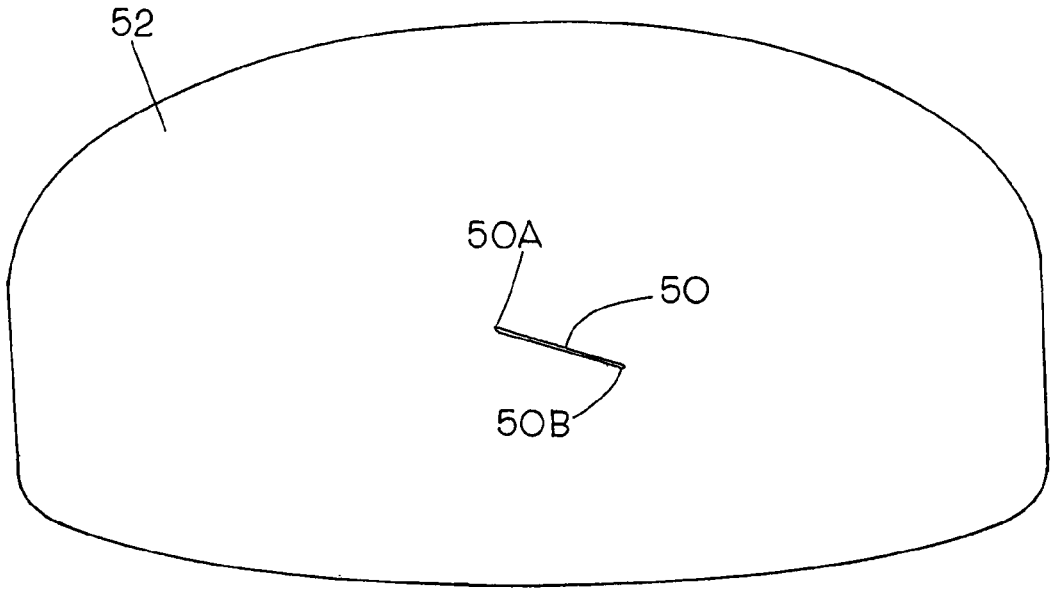
FIG. 8 illustrates a line that indicates MD at one end and BF at the other end.

FIG. 8 shows another marking which identifies the location of points MD and BF. A straight line 50 is marked on the club face 52, with one end 50A of the line 50 locating or marking MD, and the other end 50B of line 50 marking BF. The line 50 need not be straight but straight is preferred and required by the USGA to conform to the Rules of Golf. The line 50 provides the reference a golfer needs for identifying where the desired center hit points, MD and BF, for ball impact are located on the club face.

The above discussion is for the clubs used to hit a ball from a tee. A golfer should tee the ball at an appropriate height so his/her average or mean impact height on the face lies at approximately the height of MD or BF above the sole. For irons and fairway woods not hitting a ball from a tee, the same calculations can be made. For such case, MD may be in a satisfactory location on the face for long irons with low loft angle. For irons with high loft angles, it will be too high on the face with the result that the club sole would be required to be deep into the turf in order to hit the MD point. Similarly, BF may also be too high for the most lofted clubs. For a designer, calculation of these points can be useful as design targets. If they cannot be reached, the designer can come as near as practical. For these clubs, maximum distance is not of concern.

Although the present invention has been described with reference to preferred embodiments, workers skilled in the art will recognize that changes may be made in form and detail without departing from the spirit and scope of the invention.

What is claimed is:

1. A method of establishing two locations on a face of a golf club head, comprising a first location (MD) which indicates a hit center point location for maximum distance of ball travel when a ball is struck by the golf club head (MD), and a second different location (BF) wherein a ball strike centered at the second location provides no change of torque about a long axis of a golf club shaft for the golf club head, and also provides maximum distance for ball travel when a ball is struck by the golf club head while having no change of torque about the long axis of the golf club shaft, at least one of the locations being determined by one of three methods consisting of computer analysis, repeated striking of a golf ball at a series of ball impact center points on a club face determined by a golf robot or by a live golfer using suitable instrumentation for providing both ball travel distance and golf club shaft torque data, and further establishing another of the locations.

2. The method of claim 1 including the further step of determining a plurality of ball strike centered points of no change of torque about the long axis of the golf club shaft to provide a no change of torque line including BF.

3. The method of claim 1 including marking the first location and the second location on the face of the golf club head.

4. The method of claim 1 including marking at least one of the first and second locations on the face of the golf club head, and providing an indication of the distance and direction from said at least one location of the other location.

5. The method of claim 1 further including the step of providing marks for the plurality of points at which ball impact results in no change of torque on the golf club head prior to establishing the second location.

6. A golf club head having a ball striking face, and held on a golf club shaft, and an indicator on the ball striking face indicating a point along a locus of points at which a center of ball impact for a ball strike results in substantially no change of torque about a long axis of the golf club shaft, and wherein a distance of ball travel when a ball is struck with substantially no change of torque about the long axis of the golf club shaft is maximum, and a second different indicator on the ball striking face indicating a point at which a center of ball impact results in golf ball travel that is a maximum, compared with ball impact center points at any other location on the ball striking face.

7. A golf club head having a ball striking face and held on a golf club shaft, and a first indicator on the ball striking face, at a location point where a center of ball impact results in substantially no change of torque about a longitudinal axis of the golf club shaft, and provides maximum ball travel for a given golf club head speed at ball impact with no change of torque about the longitudinal axis of the golf club shaft, and a second different indicator on the ball striking face which indicates maximum ball travel distance for centers of ball strikes at all locations on the ball striking face at a given speed of the golf club head.

8. A golf club head having a ball striking face and held on a golf club shaft, a mark on the face indicating a point at which a center of ball impact at a repeatable club head speed results in maximum ball travel compared to any other point on the ball striking face, and an indicator on the face indicating a different point at which a center of ball impact at a repeatable club head speed results in maximum ball travel and no change of torque applied to the golf club shaft.

9. A method of indicating two different locations on the face of a golf club head mounted on a club shaft in which one indicator indicates a best location for centering a ball hit for maximum ball travel distance and the other indicator indicates a location for centering a ball hit by a golfer that also provides a best distance for all locations on the face of the golf club head where no torque is exerted about a long axis of the club shaft, each of the indicators being determined by one of the methods consisting of computer analysis, repeated striking by a golf robot and by a live golfer using suitable instrumentation for providing data.

* * * * *